United States Patent [19]

Kingsborough et al.

[11] Patent Number: 4,915,461

[45] Date of Patent: Apr. 10, 1990

[54] STORAGE CABINET RETRIEVAL SYSTEM

[76] Inventors: Michael R. Kingsborough, 1698 County Rd. 129, Fremont, Ohio 43420; Dale D. Owens, 2295 County Rd. 292, Bellevue, Ohio 44811

[21] Appl. No.: 362,751

[22] Filed: Jun. 7, 1989

[51] Int. Cl.[4] ..... A47F 5/08

[52] U.S. Cl. ..... 312/247; 312/248; 312/266; 312/319

[58] Field of Search ..... 312/246, 247, 248, 266, 312/272, 273, 319, 325

[56] References Cited

U.S. PATENT DOCUMENTS

| | | | |
|---|---|---|---|
| 2,555,254 | 5/1951 | Stebbins . | |
| 2,558,416 | 6/1951 | Brach . | |
| 3,205,032 | 9/1965 | Leigh . | |
| 3,331,645 | 7/1967 | Vercellotti . | |
| 3,464,749 | 9/1969 | Bishop . | |
| 3,467,460 | 9/1969 | Acker | 312/272 |
| 3,857,623 | 12/1974 | Schneller | 312/266 |
| 4,026,434 | 5/1977 | Howard . | |
| 4,076,351 | 2/1978 | Wyant . | |
| 4,134,629 | 1/1979 | Hansen . | |
| 4,412,601 | 11/1983 | Cooper . | |

FOREIGN PATENT DOCUMENTS

| | | | |
|---|---|---|---|
| 0819138 | 8/1959 | United Kingdom | 312/266 |

*Primary Examiner*—Joseph Falk
*Assistant Examiner*—Gerald A. Anderson
*Attorney, Agent, or Firm*—Marshall & Melhorn

[57] ABSTRACT

A storage device for cabinets is disclosed wherein shelves are carried by pairs of spaced, pivotally mounted arms. The arms are adapted to swing outwardly and downwardly, with the shelves maintaining a substantially horizontal attitude. A flexible cord is attached to a drawbar affixed to the shelf assembly, and a power unit is provided for extending and retracting the cord to move the shelf assembly between storage and retrieval positions.

8 Claims, 3 Drawing Sheets

STORAGE CABINET RETRIEVAL SYSTEM

BACKGROUND OF THE INVENTION

1. Field of the Invention

The present invention pertains generally to wall mounted storage cabinets, and more particularly to a shelf mounting system for such cabinets having shelves which are normally concealed within the cabinet in the conventional manner and which are operable by persons not otherwise able to reach them to swing outwardly and downwardly for ready access by such persons.

2. Description of the Prior Art

Conventional cabinets, particularly of the wall mounted type normally found in standard kitchens, are practically inaccessible and thus of very little use to certain groups of people. Thus handicapped people, particularly those in wheelchairs, who are otherwise capable of performing normal homemaking activities within the kitchen and other areas of the home, may be unable to reach items stored in these wall cabinets. Likewise, the elderly ad little people have difficulty storing and retrieving items in such cabinets. Even unhandicapped people of average height have difficulty in reaching the top shelves, and often must precariously stand on a chair or ladder to see or reach items stored thereon.

As a result the top shelves, if not the entire system of wall cabinets, are unusable by such persons in conventionally designed kitchens and baths. Redesign of the kitchen to provide additional low storage space may not be feasible because of cost and space constraints, as well as aesthetic considerations. The upper wall area often represents the best available area for providing storage space. In order to make such space more accessible it has been proposed in U.S. Pat. No. 2,555,254 to provide self lowering cabinets wherein the lower portion of the cabinet is stationary, and the upper portion is mounted upon toothed racks engaged by pinion gears so as to move outwardly and downwardly in front of the lower portion for better access. U.S. Pat. No. 2,558,416 discloses a swing down shelf arrangement for cabinets wherein the shelves are mounted upon arms so that with the assistance of a system of springs and pulleys they may swing outwardly and downwardly to a lowered position of more convenient access. By varying the number of springs connected to the shelf arrangement it is said to be possible to maintain the spring tension substantially proportionate to the load as the shelves swing up and down, thus enabling manual operation of the shelves. In U.S. Pat. No. 4,134,629, there is proposed a kitchen cabinet including a system of linkages whereby a door pivots and folds upwardly and away to thereafter permit shelves to pivot outwardly and downwardly for easier access.

While the above and other prior art devices are of assistance in providing access to normally elevated storage shelves, none has proved entirely satisfactory for use by people with various disabilities, and particularly by handicapped people in wheelchairs. The devices have been relatively complicated and expensive to manufacture and install, and most are not readily and safely operable by very short persons or those seated as in a wheelchair. Most involve the installation of specially designed cabinets incorporating the lowering and raising feature.

SUMMARY OF THE INVENTION

In accordance with the present invention there is provided a cabinet storage retrieval system for installation in new or existing wall cabinets. The system is delivered as a unit ready for insertion in the cabinet in place of the existing stationary shelves, and includes shelves carried by pairs of spaced, pivotably mounted arms. The arms are adapted to swing outwardly and downwardly while the shelves carried thereby remain substantially horizontal. A cord attached to the arm and shelf assembly winds upon a drum or spool carried by a reversing gear drive unit for selectively lowering and raising the shelf assembly. Switch means is mounted in a convenient location for initiating operation of the unit. Limit switches are provided for stopping the drive unit with the shelf assembly in the fully raised and lowered positions.

It is therefore an object of the invention to provide an improved cabinet storage retrieval system.

Another object of the invention is to provide such a system making wall mounted cabinets accessible for storage by persons unable to reach them because of their height.

Another object of the invention is to provide such a system comprising a unit which can be relatively easily installed in existing wall cabinets.

Still another object of the invention is to provide such a unit which is durable and yet relatively inexpensive to manufacture.

Yet another object of the invention is to provide such a unit which can be easily and safely operated by handicapped persons unable to reach into the cabinet.

Other objects and advantages will become apparent during the course of the following description when taken in connection with the accompanying drawings.

BRIEF DESCRIPTION OF THE DRAWINGS

In the drawings, wherein like numerals refer to like parts throughout.

DESCRIPTION OF THE PREFERRED EMBODIMENTS

Figure 1:
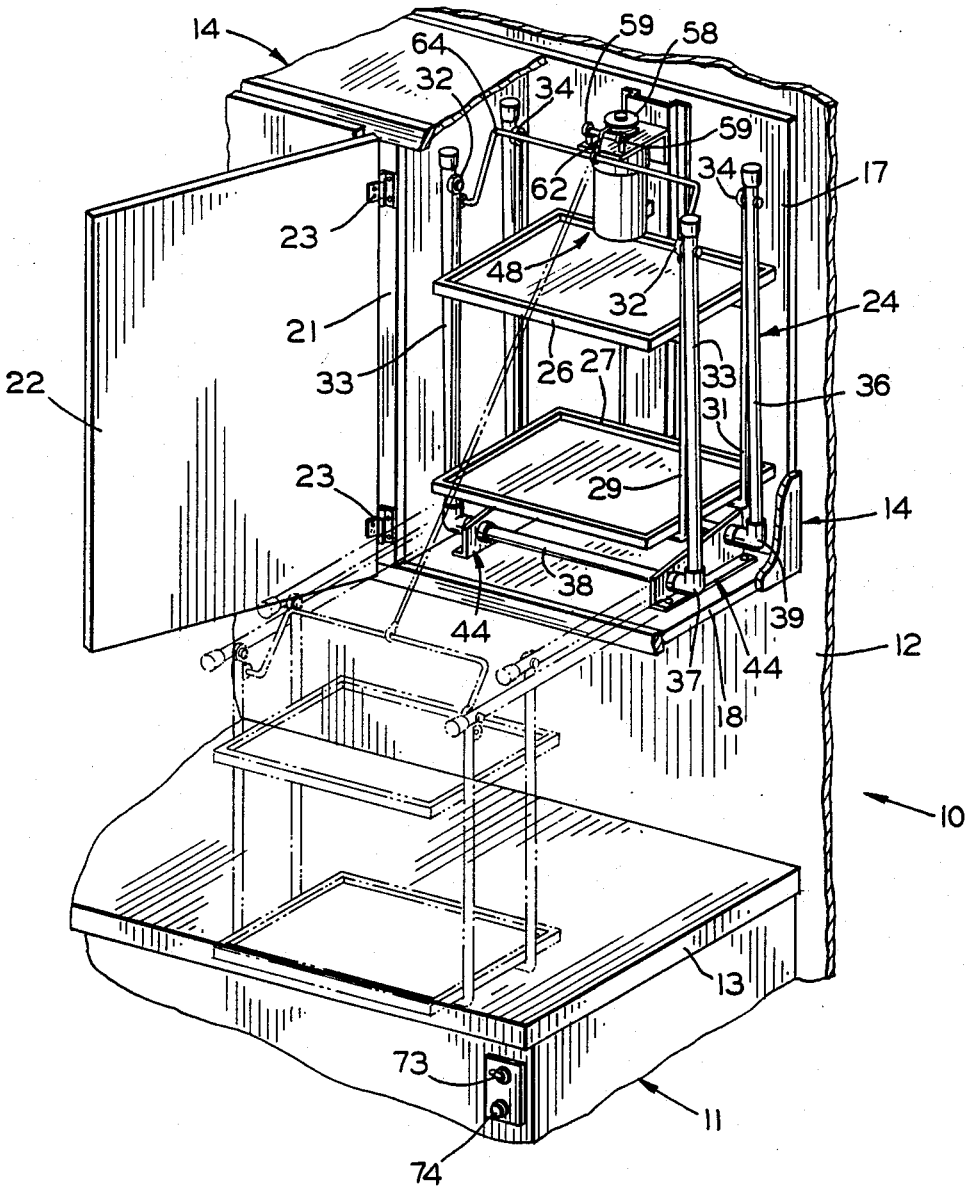
FIG. 1 is a perspective view, with parts broken away, of a cabinet having a storage retrieval unit constructed in accordance with the invention incorporated therein, the shelves being shown in broken lines in their lowered position.
Figure 4:
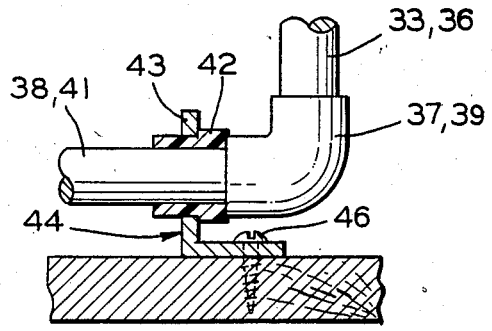
FIG. 4 is an enlarged, fragmentary, front elevational view, partially in section, illustrating a pivot arm in a support bearing.
Figure 2:
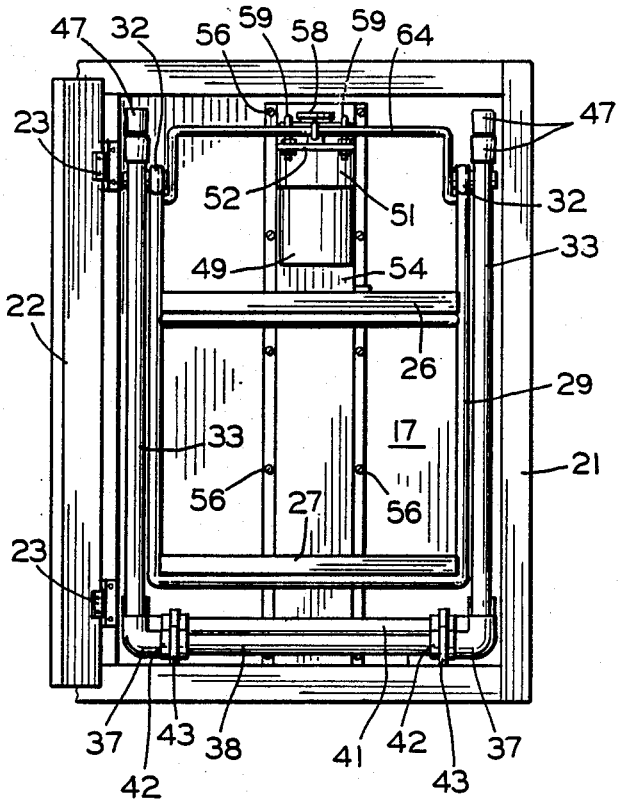
FIG. 2 is a front elevational view of the upper cabinet with the storage retrieval unit therein.

Referring now to the drawings and in particular to FIG. 1, there is shown generally at 10 a cabinet system as conventionally found in kitchens of present day homes. It will be readily understood that while the invention is described herein with reference to a kitchen and kitchen cabinets, it is equally applicable to other areas where elevated cabinets are employed such as in bathrooms and workshops. More particularly, the cabinet system comprises one or more base cabinets 11 mounted on the floor (not shown) along a wall 12 and having a counter top 13 thereon. Affixed to the wall 12 above the base cabinets is one or more suspended wall cabinets 14. Such base and wall cabinets are generally prefabricated in standard sizes and arranged end to end along a wall as storage units. Each wall cabinet includes opposite side walls 16, a rear wall 17, a bottom wall or floor 18, a top 19 and a front framework 21, all interconnected to define a storage area therewithin. A door 22 is affixed to the framework 21 by hinges 23 for closing the front of the cabinet and presenting a pleasing visual appearance. Conventionally, one or more shelves (not shown) are supported at their ends upon adjustable supports carried by the side walls 16.

Figure 3:
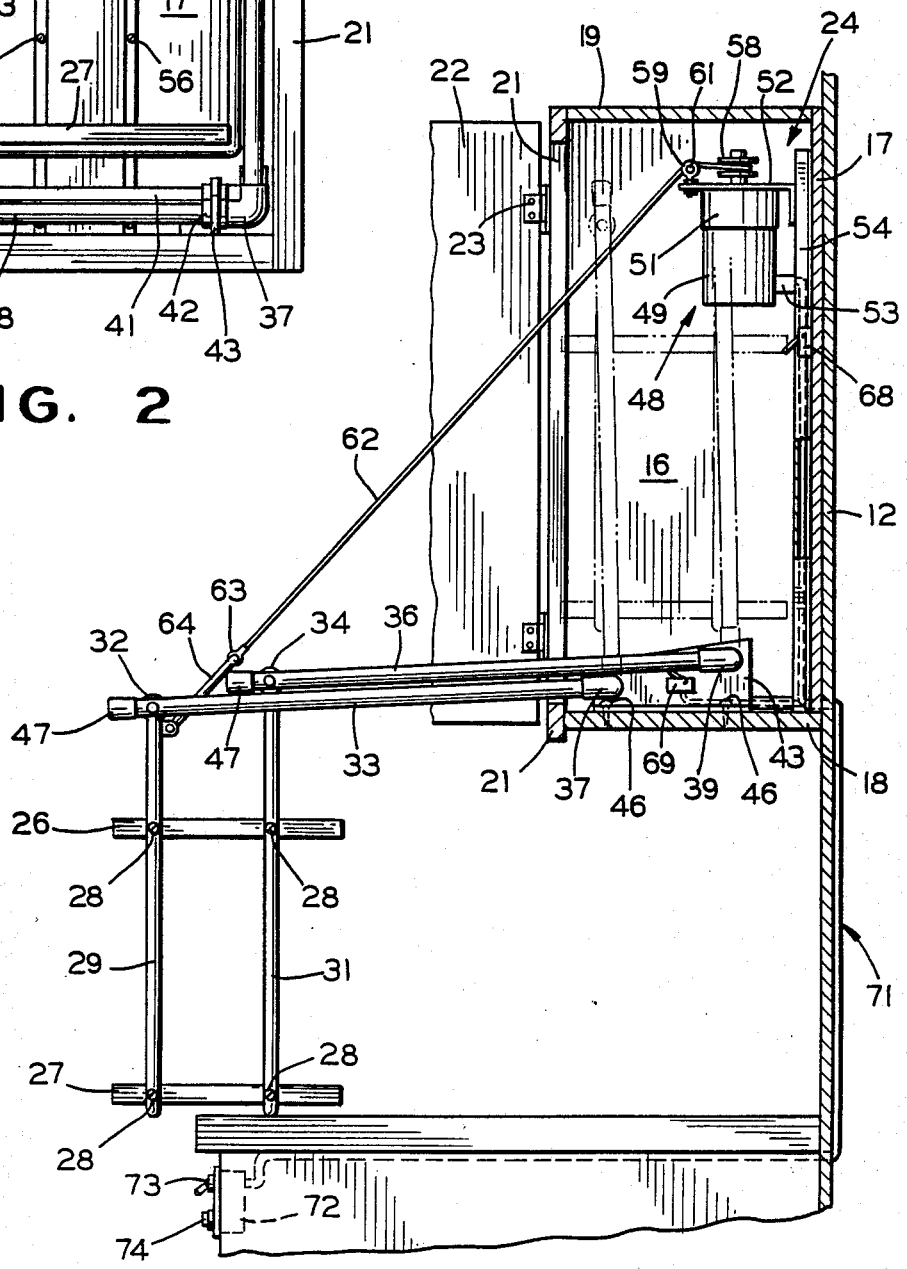
FIG. 3 is an end elevational view taken as from the right in FIG. 1, with the shelves of the unit in lowered position and shown in broken lines in the raised, storage position.

In place of the conventional shelves, there is provided within the cabinet in accordance with the invention a storage retrieval system, identified generally at 24. As best seen in FIG. 1, the system includes spaced upper and lower shelves or trays 26 and 27, respectively. As will be readily apparent, and as is shown in FIGS. 1 and 3, the supporting surfaces of the shelves must remain substantially horizontal as they move between the raised, storage and lowered, retrieval positions. To that end, the shelves are affixed at their ends by connecting means 28 to front and rear sling members or pairs of posts 29 and 31, respectively. As viewed endwise, the sling members and shelves define a parallelogram, and thus so long as the side members of the slings remain vertical, the shelves will be parallel and horizontal. The front sling member is suspended at its upper ends by pivot connections 32 from spaced front arms 33, and the rear sling member 31 is likewise suspended at its upper ends by pivot connections 34 from spaced rear arms 36.

The arms 33 and 36 are preferably of tubular construction so as to provide maximum strength with minimum weight. The front arms 33 are joined by means of elbows 37 to a transverse shaft 38, and the rear arms 36 are likewise joined by means of elbows 39 to a transverse shaft 41. The shafts 38 and 41 are journalled as in nylon bearings 42 carried by upright legs 43 of spaced angle brackets 44. As best seen in FIG. 3, the rear shaft 41 is elevated above the front shaft 38 so that when in the lowered position, the rear legs 36 will be disposed above the front legs 33. The bearings 42 are positioned and the arms are so dimensioned and supported that the shelves maintain a substantially horizontal attitude during movement between the raised and lowered positions. The bracket may be secured to the floor 18 of the cabinet as by screws 46, or by bolts (not shown) extending through the floor. For purposes of appearance and safety, the free ends of the arms 33 and 36 may be provided with resilient caps or tips 47 of the type conventionally employed with tubular legs of furniture.

The shelf assembly is extended and retracted by means of a power unit provided within the cabinet 14 and identified generally at 48. More particularly, the power unit comprises a reversible motor 49 and associated gear reduction unit 51 affixed by a bracket 52 and post 53 to a vertically extending mounting channel or beam 54 at the rear of the cabinet. The mounting channel is securely affixed to the rear wall 17 of the cabinet as by fasteners 56 extending into the wall 17. Of course, if the wall 17 is not of sufficient thickness to thus affix the mount channel, conventional anchors (not shown) may be provided in the cabinet rear wall or the room wall 12 there behind for receiving the fasteners 65.

The gear reduction unit 51 includes an output shaft 57 upon which is mounted a spool or reel 58. Spaced eyelets 59 mounted at the front of the bracket 52 on either side of the reel 58 support smooth surfaced guide rod 61. A durable flexible cord 62 as of nylon, affixed at one end to the reel 58 and adapted to be wound upon and unwound from the reel by operation of the power unit 48 as will be hereinafter explained, extends or rides over the guide rod 61 and is affixed at its distal end, by means of an eyelet 63, to a drawbar or bail 64. The drawbar is of generally U-shaped construction and includes outwardly directed extensions 66 at its ends pivotably received in projections 67 on the front sling 29. The eyelet 63 is adjustably slidable along the base member of the drawbar should it be necessary to compensate for uneven loading of the shelves 26 and 27 from side-to-side. As best seen in FIG. 3, an upper limit switch 68 is provided on the mounting channel 54 in position to be activated by the shelf 26 as with the shelf assembly reaches the fully retracted position, and a lower limit switch 69 is provided on the angle bracket 44 in position to be activated by one of the rear arms 36 when the shelf assembly reaches the fully extended or lowered position.

For ease of installation the unit is preferably assembled and pre-wired prior to shipment. The details of such a wiring system will be readily apparent to those having ordinary skill in the art, and a detailed explanation is believed unnecessary. A wiring harness is shown more or less schematically at 71 in FIG. 3, and includes a control box 72 which can be suitably located so as to be readily accessible for operation by a particular user, for example, a person seated in a wheelchair. Thus, as shown in FIGS. 1 and 3 the box may advantageously be mounted in the front of the base cabinet 11. The wiring harness may extend through the base cabinet beneath the counter top 13 and upwardly along or within the wall 12 to the wall cabinet 14. It may then extend within the mounting channel 54 to the power unit 48. The control box 72 includes a toggle switch 73 for controlling the direction of operation of the power unit, that is, in one position of the toggle switch the power unit will operate to unwind cord from the reel 58 and lower the shelf assembly, and in its other position the unit will reverse and wind the cord upon the reel to raise the shelf assembly. The control box also includes a power button or switch 74 by which the operator activates the unit. For safety purposes the power button is preferably of the spring-loaded type requiring that it be held in a depressed position for operation of the power unit. Of course, if the nature of the user's handicap is such as to preclude continuous depression of the button, other and different types of power switches may be substituted.

Figure 5:
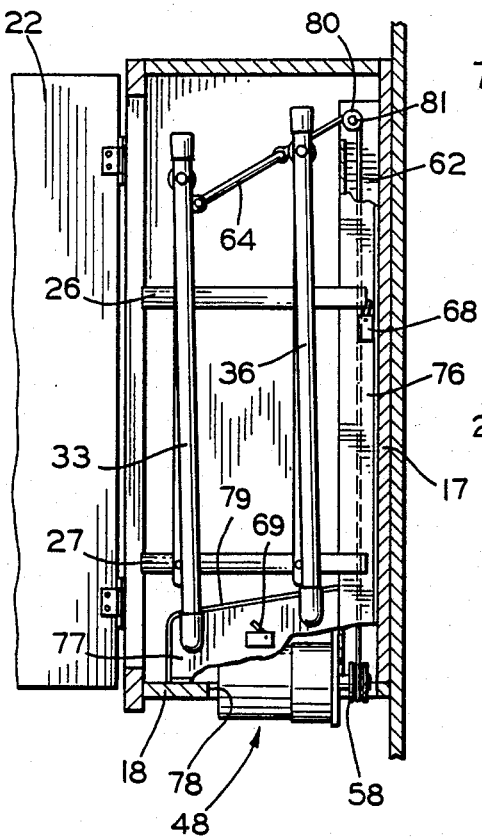
FIG. 5 is a right and elevational view, partially in section, of an alternate embodiment of the invention.
Figure 6:
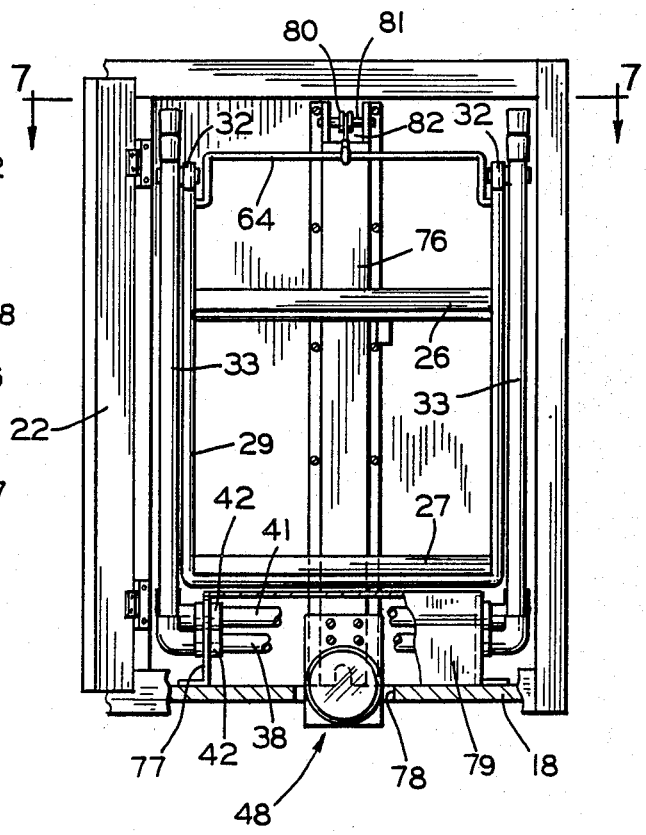
FIG. 6 is a front elevational view of the alternate embodiment.
Figure 7:
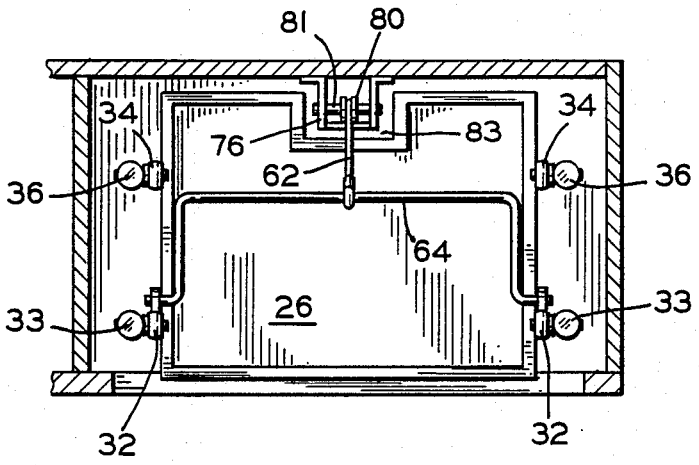
FIG. 7 is a top plan view taken substantially along line 7—7 of FIG. 6.

There is shown in FIGS. 5, 6 and 7 an alternate embodiment of the invention wherein the power unit is located at the bottom of the storage cabinet so as to minimize interference with storage upon the shelves. In other respects the device is basically identical in function and structure to the embodiment of FIGS. 1 through 4. More particularly, the power unit 48 of the alternate embodiment is mounted at the lower end of a mounting channel 76 which is somewhat deeper than the mounting channel 54 in order to accommodate the reel 58. Upright legs 77 in which the bearings 42 are mounted for carrying the arms 33 and 36 are somewhat taller than the upright legs 43 to permit installation of the power unit beneath the shafts 38 and 41. The floor 18 of the cabinet also includes an opening 78 within which the power unit 48 is recessed. A cover 79 may be provided between the spaced upright legs 77 of the angle brackets for concealing the power unit and shafts 38 and 41 from view. Alternatively, it is contemplated that the cover 79 and the upright legs 77 of the brackets 44 may be formed as an integral unit, and that the legs 43 of the brackets 44 in the previously described embodiment may similarly be fabricated with a cover (not shown) as an integral unit.

A pulley 80 is rotatably mounted upon a shaft 81 carried at its ends in the side walls of the mounting channel 76 at the upper end thereof. The base of the mounting channel is cut away to leave an open area as at 82. The flexible cord 62 thus extends from the reel 58 upwardly within the mounting channel and about the pulley 79 for attachment to the drawbar 64. As best seen in FIG. 7, the shelves or trays 26 and 27 may be formed with a recessed area 83 along their rear edge to accommodate the mounting channel 76 and thereby increase the storage area upon the shelves.

Reviewing briefly installation and operation of the novel storage cabinet retrieval system, by way of example the preassembled mounting channel and power unit 48 may first be installed at the rear of the cabinet. The shelf assembly is then installed, with the angle brackets being affixed to the bottom wall 18 of the cabinet. The flexible cord 62 is secured to the drawbar 64 and properly wound upon the reel 58. Finally, the control box 72 is mounted and appropriate connections to the wiring harness are made. In operating the storage retrieval system, the cabinet door 22 is first opened. While the bottom of the door can generally be reached by a person sitting in a wheelchair, it is contemplated that an extension handle (not shown) may be provided at the lower end of the door for use by those unable to reach the door. Also, it is contemplated that the door will open in response to lowering of the shelf assembly if it has not been previously opened.

As will be noted in FIGS. 3 and 5, the shelf assembly is so constructed and installed that the arms 33 and 36 lean slightly forward when in the fully retracted position. In other words, the shelves are suspended slightly forward of dead center so as to maintain tension upon the flexible cord 62. This insures that the shelf assembly will swing outwardly upon extension of the flexible cord, and that the cord will remain properly entrained about the reel 58 and the pulley 79. Thus, to extend the shelf assembly following opening of the door, the operator places the toggle switch 73 in the down or extension mode, bypassing the upper limit switch 68. The power button 74 is then depressed to activate the power unit 48 and play out the flexible cord 62 from the reel 58. As the shelf assembly reaches its extended or lowered position the arm 36 engages the lower limit switch 69, discontinuing operation of the power unit. At this point, as shown in FIGS. 1 and 3, the shelf assembly will preferably rest upon the countertop 13, making the shelves 26 and 27 readily accessible. Of course, operation may also be discontinued at any point by releasing the power button 74. In order to raise or retract the shelf assembly, the toggle switch 73 is moved to the up position, bypassing the limit switch 69 and reversing the direction of operation of the power unit 48. The power button is then depressed to operate the power unit, winding the cord upon the reel and raising or retracting the shelf assembly. When the assembly reaches the fully retracted position the shelf 26 will engage the upper limit switch 68, discontinuing operation of the power unit.

It is to be understood that the forms of the invention herewith shown and described are to be takes as illustrative embodiments only of the same, and that various changes in the shape, size and arrangement of parts may be resorted to without departing from the spirit of the invention.

What is claimed is:

1. A storage and retrieval apparatus for use with elevated cabinets comprising, in combination, spaced pairs of front and rear arms, mean pivotally mounting said arms at their lower ends for swinging movement into and out of said cabinet, a first sling member pivotally carried at its upper ends between said spaced front arms, a second sling member pivotally carried at its upper ends between said spaced rear arms, a shelf means carried by said first and second sling members in a generally horizontal attitude, a flexible cord attached at the upper end of the swinging arm sling member assembly, a power unit including a rotatably driven reel adapted for winding and unwinding said flexible cord, and switch means operable to selectively activate said power unit in forward and reverse directions for winding and unwinding said flexible cord to thereby swing said arms carrying said shelf means between a storage position within said cabinet and a retrieval position outside said cabinet.

2. A storage and retrieval apparatus as claimed in claim 1, including a second shelf means carried by said first and second sling members parallel to and spaced from said first shelf means.

3. A storage and retrieval apparatus as claimed in claim 1, including drawbar means extending between and connected to the upright legs of said first sling member, said flexible cord being attached to said drawbar means for swinging said arms and shelf means between said storage and said retrieval positions.

4. A storage and retrieval apparatus as claimed in claim 1, including a mounting beam within said cabinet behind said shelf means, said power unit being mounted upon a bracket affixed to said mounting beam above said shelf means, and a horizontal guide member on said bracket over which said flexible cord rides between said reel and said swinging arm sling member assembly.

5. A storage and retrieval apparatus as claimed in claim 1, wherein said cabinet includes a rear wall, a vertically extending channel-shaped mounting beam affixed to said rear wall, and defining with said wall an enclosed vertical passageway, said power unit being mounted at the lower end of said mounting beam below said shelf means, said reel being positioned in alignment with said vertical passageway, and pulley means at the upper end of said passageway, whereby said flexible cord extends from said reel within said passageway and over said pulley means.

6. A storage and retrieval apparatus as claimed in claim 1, wherein said cabinet comprises a floor, a rear wall, and spaced side walls, including a pair of spaced angle brackets affixed to said floor, each said bracket including an upstanding leg, a horizontal shaft interconnecting each said spaced pair of front and rear arms at their lower ends, and bearing means journalling said horizontal shafts in said upstanding legs, the rear one of said horizontal shafts being elevated above the forward shaft whereby said rear arms are disposed above said front arms in the shelf retrieval position outside said cabinet.

7. A storage and retrieval apparatus as claimed in claim 1, wherein said switch means comprises a first switch for selecting the direction of operation of said power unit, and a second switch for selectively connecting said power unit to a source of electrical energy.

8. A storage and retrieval apparatus as claimed in claim 7, wherein said second switch includes a manual operating member for activation by a user and adapted to disconnect said power unit from said source of electrical energy in the absence of said manual activation.

* * * * *